US010041500B2

(12) United States Patent
Streit

(10) Patent No.: US 10,041,500 B2
(45) Date of Patent: Aug. 7, 2018

(54) VENTURI EFFECT ENDWALL TREATMENT

(71) Applicant: General Electric Company, Schenectady, NY (US)

(72) Inventor: Josef Anton Streit, Freising (DE)

(73) Assignee: General Electric Company, schenectady, NY (US)

( * ) Notice: Subject to any disclaimer, the term of this patent is extended or adjusted under 35 U.S.C. 154(b) by 294 days.

(21) Appl. No.: 14/962,103

(22) Filed: Dec. 8, 2015

(65) Prior Publication Data

US 2017/0159667 A1 Jun. 8, 2017

(51) Int. Cl.
*F04D 27/00* (2006.01)
*F04D 29/32* (2006.01)
(Continued)

(52) U.S. Cl.
CPC ..... *F04D 27/009* (2013.01); *F04D 29/324* (2013.01); *F04D 29/526* (2013.01); *F04D 29/545* (2013.01); *F04D 29/685* (2013.01); *F05B 2220/302* (2013.01); *F05B 2240/30* (2013.01); *F05D 2270/101* (2013.01)

(58) Field of Classification Search
CPC .... F04D 27/009; F04D 29/324; F04D 29/526; F04D 29/545; F04D 29/685; F05B 2220/302; F05B 2240/30; F05D 2270/101
See application file for complete search history.

(56) References Cited

U.S. PATENT DOCUMENTS 3,970,319 A 7/1976 Carroll et al.
4,466,772 A 8/1984 Okapuu et al.
(Continued)

FOREIGN PATENT DOCUMENTS

CN 1133404 A 10/1996
EP 1 832 717 A1 9/2007
EP 3 081 779 A1 10/2016

OTHER PUBLICATIONS

"Axial-Slot Casing Treatments Improve The Efficiency of Axial Flow Compressor: Aerodynamic Effects of a Rotary Redesign", Proceeding of ASME Turbo Expo 2013, GT2013-94975.
(Continued)

*Primary Examiner* — Igor Kershteyn
(74) *Attorney, Agent, or Firm* — General Electric Company; Brian Overbeck

(57) ABSTRACT

A gas turbine engine endwall treatment includes a recirculation passages distributed circumferentially around and extending generally axially in an endwall or shroud, Venturi effect producing main throats between main inlet and outlet passages including main inlet and outlet ports respectively extending through the endwall or shroud, and main inlet ports axially aft and downstream of the main outlet ports. Second inlet passages may connect second inlet ports in endwall to main recirculation passages at or near main throats and second inlet ports. An annular groove in endwall may pass through and interconnect the second inlet ports. Two or more clustered inlet passages may extend from two or more clustered secondary inlet ports to two or more intersections of the two or more clustered inlet passages and the main recirculation passage. The main inlet and outlet ports may be spaced one or more stages apart.

17 Claims, 5 Drawing Sheets

(51) Int. Cl.

| | |
|---|---|
| ***F04D 29/54*** | (2006.01) |
| ***F04D 29/52*** | (2006.01) |
| ***F04D 29/68*** | (2006.01) |

(56) References Cited

U.S. PATENT DOCUMENTS

| | | | | |
|---|---|---|---|---|
| 4,714,406 | A | 12/1987 | Hough | |
| 5,282,718 | A | 2/1994 | Koff et al. | |
| 5,431,533 | A | 7/1995 | Hobbs | |
| 5,607,284 | A | 3/1997 | Byrne et al. | |
| 6,220,012 | B1 | 4/2001 | Hauser et al. | |
| 6,264,425 | B1 * | 7/2001 | Keller | F01D 5/225 415/110 |
| 6,290,458 | B1 * | 9/2001 | Irie | F01D 5/145 415/119 |
| 6,585,479 | B2 | 7/2003 | Torrance | |
| 6,935,833 | B2 * | 8/2005 | Seitz | F01D 5/145 415/58.1 |
| 7,074,006 | B1 | 7/2006 | Hathaway et al. | |
| 7,811,049 | B2 * | 10/2010 | Xu | F01D 11/10 415/145 |
| 8,043,046 | B2 * | 10/2011 | Guemmer | F04D 29/681 415/115 |
| 8,082,726 | B2 * | 12/2011 | Cloft | F02C 9/18 137/15.1 |
| 8,100,629 | B2 | 1/2012 | Lebret | |
| 8,683,811 | B2 * | 4/2014 | Clemen | F02C 6/08 60/204 |
| 2010/0034637 | A1 | 2/2010 | Guemmer | |
| 2011/0311354 | A1 | 12/2011 | Goswami et al. | |

OTHER PUBLICATIONS

Extended European Search Report and Opinion issued in connection with corresponding EP Application No. 16200842.9 dated Apr. 18, 2017.

Machine Translation and First Office Action and Search issued in connection with corresponding CN Application No. 201611121240.2 dated Feb. 24, 2018.

* cited by examiner

VENTURI EFFECT ENDWALL TREATMENT

BACKGROUND OF THE INVENTION

Technical Field

This invention relates to tip shroud assemblies of axial flow gas turbine engine compressors and, specifically, to such shrouds which recirculate air through the shrouds at the tips of airfoil in the compressor.

Background Information

Aircraft axial flow gas turbine engine compresses air in a compressor section, mixes the compressed air with fuel and combusts the resultant mixture in a combustor section, and expands the hot exhaust flow through a turbine section that, via one or more shafts, drives the compressor section. Overall engine efficiency is a function of, among other factors, the efficiency with which the compressor section compresses the air. The compressor section typically includes a low pressure compressor driven by a shaft connected to a low pressure turbine in the turbine section, and a high pressure compressor driven by a shaft connected to a high pressure turbine in the turbine section. The high and low compressors each include several stages of compressor blades and stators or vanes.

The high and low compressors each include several stages of compressor blades rotating about the longitudinal axis of the engine. Each blade has an airfoil that extends from a blade platform to a blade tip. The blade tips rotate in close proximity to an outer air seal referred to as a "tip shroud". The tip shroud circumscribes the blade tips of a given stage. The blade platforms and the tip shroud define the radially inner and outer boundaries, respectively, of the airflow gaspath through the compressor. In order to maximize the efficiency of a gas turbine engine, it would be desirable, at a given fuel flow, to maximize the pressure rise (hereinafter referred to as "pressure ratio") across each stage of the compressor.

As is well known by gas turbine engine practitioners, stall or surge is a phenomenon that is characteristic of all types of axial or centrifugal compressors that limits their pressure rise capability. During compressor operation, stall occurs when the streamwise momentum imparted to the air by the blades is insufficient to overcome the pressure rise across the compressor stage resulting in a reduction in airflow through a portion of the compressor stage. The flow leakage that occurs across the clearance gap between the compressor rotor blade tip and stationary casing endwall is one well known mechanism for reducing the total streamwise momentum through the blade passage, thus, reducing the blade pressure rise capability and moving the compressor closer towards the stall condition. Compressor stall is a condition in which the flow of air through a portion of a compressor stage ceases, because the energy imparted to the air by the blades of the compressor stage is insufficient to overcome the pressure ratio across the compressor stage. If no corrective action is taken, the compressor stall may propagate through the compressor stage, starving the combustor of sufficient air to maintain engine speed. Under some circumstances, the flow of air through the compressor may actually reverse direction, in what is known as a compressor surge. Compressor stalls and surges are very much unwanted.

Various forms of endwall treatments have been employed for enhancing compressors stall range, generally at the expense of compressor efficiency. Endwall treatments and designs utilizes the static pressure rise created at the compressor to recirculate high-pressure fluid to energize low momentum fluid along the casing, hereinafter referred to as endwall blockage. To energize the low momentum fluid, high-pressure fluid is channeled from the rear to the front of a compressor blade through a passage contained within the casing surrounding the compressor. The high-pressure fluid is then reinjected upstream of the blade to energize the low momentum fluid at the casing. Examples of such endwall treatments are disclosed and described in U.S. Pat. No. 5,607,284 issued Mar. 4, 1997 to Byrne et al., and U.S. Pat. No. 7,074,006 issued Jul. 11, 2006 to Hathaway et al.

The pressure gradient between high pressure downstream inlet ports and low pressure upstream passage outlet ports of the passages is not always sufficient to draw enough air into the passage. It is, thus, highly desirable to have an endwall treatment that is better able to operate sufficiently over a wide range of engine operating conditions to avoid stall and surge.

SUMMARY OF THE INVENTION

A gas turbine engine endwall treatment including a plurality of main recirculation passages distributed circumferentially around and extending generally axially in an endwall or shroud, each of the main recirculation passages including a Venturi effect producing main throat disposed between a main inlet passage and a main outlet passage, main inlet and outlet ports of the main inlet and outlet passages respectively extending through the endwall or shroud, and the main inlet port located axially aft and downstream of the main outlet port in each of the main recirculation passages.

The endwall treatment may further include second inlet passages connecting second inlet ports in the endwall or the shroud to the main recirculation passages at or near the main throats and the second inlet ports distributed in a circular row around the endwall or the shroud. Second throats may be disposed in the second inlet passages at or near intersections of the second inlet passages and the main recirculation passages. An annular groove in the shroud or endwall may pass through and interconnect the second inlet ports distributed circumferentially around the endwall or the shroud.

One embodiment of endwall treatment includes two or more clustered inlet passages extending from two or more clustered secondary inlet ports to two or more intersections of the two or more clustered inlet passages respectively and the main recirculation passage in the shroud or endwall. The two or more clustered inlet passages may extend from the two or more clustered secondary inlet ports to two or more clustered secondary throats at or near the two or more intersections of the two or more clustered inlet passages respectively and the main recirculation passage in the shroud or endwall. Two or more annular grooves may be disposed in the shroud or endwall passing through and interconnecting the second inlet ports distributed circumferentially around the endwall or the shroud in circular rows of the second inlet ports respectively.

A gas turbine engine compressor stage includes a circular row of compressor blades including axially spaced apart leading and trailing edges and airfoils extending radially outwardly to blade tips. An endwall including a shroud circumscribes the blade tips and the tips generally radially located in close proximity to the endwall and the shroud. An endwall treatment located in the endwall includes a plurality of main recirculation passages or passages distributed circumferentially around and extending generally axially in an endwall or shroud. Venturi effect producing main throats are disposed between main inlet and outlet passages including main inlet and outlet ports respectively extending through the endwall or shroud. The main inlet ports are located axially aft and downstream of the blade tips and the main outlet ports located axially forward and upstream of the blade tips and the main inlet ports are located axially aft and downstream of the main outlet ports in the main recirculation passages.

The main inlet ports may be located axially aft and downstream of the blade tips and the main outlet ports located axially forward and upstream of the blade tips. Second inlet passages may connect a circular row of second inlet ports in the endwall or the shroud to the main recirculation passages at or near to the main throats. Second throats may be disposed in the second inlet passages at or near intersections of the second inlet passages and the main recirculation passages.

The gas turbine engine compressor stage may include two or more clustered inlet passages extending from two or more clustered secondary inlet ports to two or more intersections of the two or more clustered inlet passages respectively and the main recirculation passage in the shroud or endwall.

The two or more clustered inlet passages may include two or more clustered secondary throats at or near the two or more intersections of the two or more clustered inlet passages respectively. Two or more annular grooves in the shroud or endwall may pass through and interconnect the second inlet ports distributed circumferentially around the endwall or the shroud in circular rows.

A gas turbine engine compressor assembly includes upstream and downstream stages including upstream and downstream stage blades. The upstream and downstream stage blades include axially spaced apart leading and trailing edges and airfoils extending radially outwardly to blade tips. An endwall includes shrouds circumscribing the blade tips which are generally radially located in close proximity to the endwall and the shrouds. An endwall treatment in the endwall includes a plurality of main recirculation passages distributed circumferentially around and extending generally axially in an endwall or shroud. Venturi effect producing main throats disposed between main inlet and outlet passages include main inlet and outlet ports respectively extending through the endwall or shroud. The main inlet ports are located axially aft and downstream of the blade tips of the downstream stage blades and the main outlet ports are located axially forward and upstream of the blade tips of the upstream stage blades. The main inlet ports are located axially aft and downstream of the main outlet ports in the main recirculation passages.

The endwall treatment may include two or more clustered inlet passages extending from two or more clustered secondary inlet ports to two or more intersections of the two or more clustered inlet passages respectively and the main recirculation passage in the shroud or endwall and the two or more clustered secondary inlet ports may be located in the first or upstream stage radially spaced apart and in the vicinity of the blade tips of the upstream stage blades.

The downstream stage may be two or more stages downstream from the upstream stage.

DETAILED DESCRIPTION OF THE INVENTION

Figure 1:
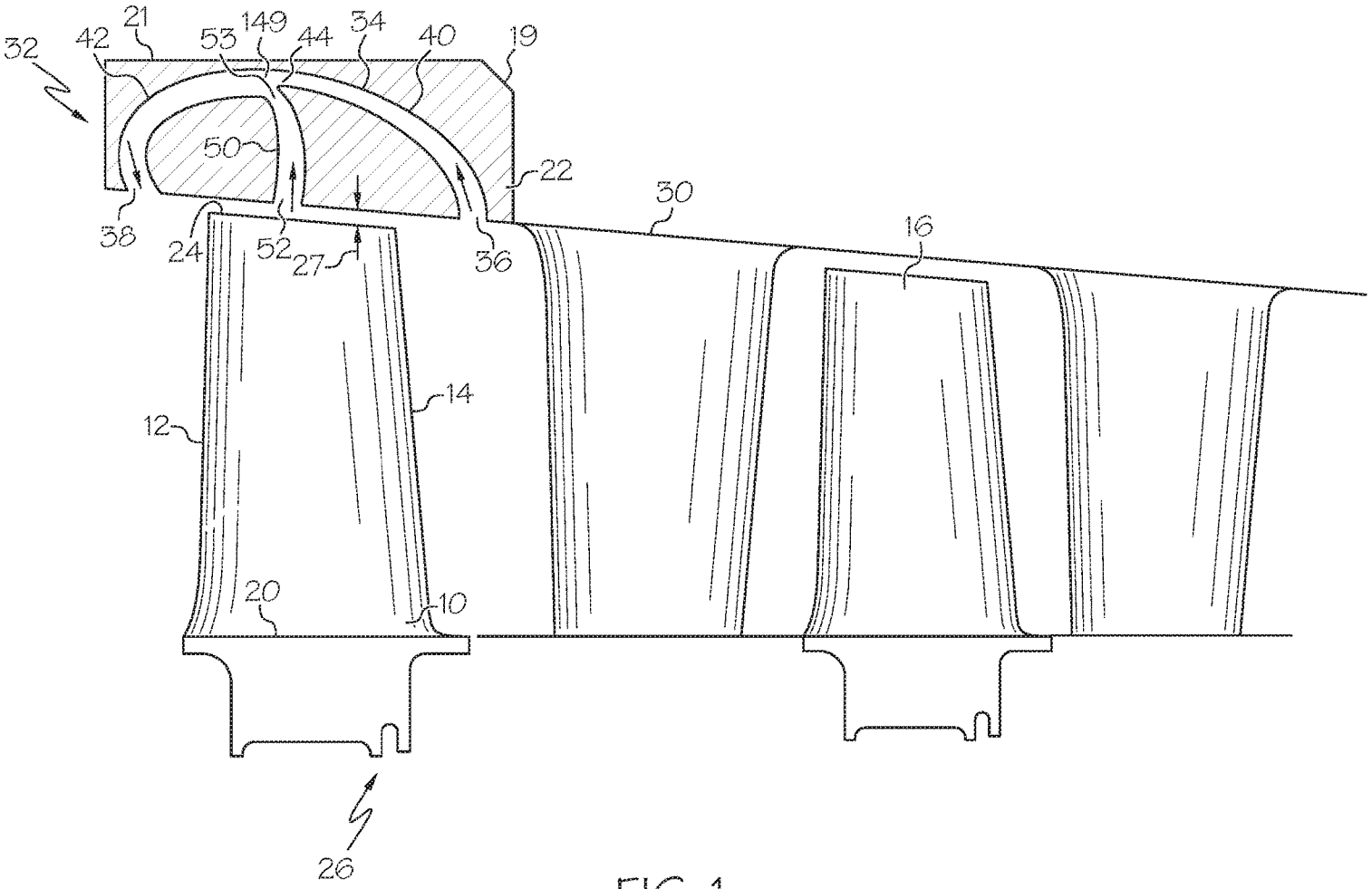
FIG. 1 is a cross-sectional view schematic illustration of a gas turbine engine compressor section including a compressor blade circumscribed by a shroud having a Venturi effect endwall treatment.

Illustrated in FIG. 1 is an exemplary gas turbine engine compressor blade 10 including axially spaced apart leading and trailing edges 12, 14. The blade 10 includes an airfoil 16 extending radially outwardly from a blade platform or airfoil base 20 to a blade tip 24. A casing 21 includes an endwall 19 having at least one shroud 22 circumscribing the tips 24 of the blades 10. The tips 24 are generally radially located in close proximity to the shroud 22 which may also be referred to as the endwall 19. Between the shroud 22 and the blade tips 24 is a tip clearance 27. FIG. 1 illustrates two compressor stages 26 with each of the stages containing a blade 10 followed downstream by a vane or stator 30. Each of the blades 10 is circumscribed by a shroud 22.

An endwall treatment 32 in the endwall 19 or the shroud 22 that at least in part circumscribes the blade tips 24. The endwall treatment 32 includes a plurality of main recirculation passages 34 distributed circumferentially around (see also FIG. 5) and extending generally axially through the shroud 22 and including at least a main throat 44 in each of the main recirculation passages 34. Each of the main recirculation passages 34 includes a main inlet port 36 axially aft and downstream of the blade tip 24 and a main outlet port 38 axially forward and upstream of the blade tip 24. The main recirculation passage 34 includes main inlet and outlet passages 40, 42 separated by the main throat 44. The main throat 44 is generally axially located between the leading and trailing edges 12, 14 of the blade 10 at the blade tip 24.

The exemplary embodiment of the main recirculation passage 34 illustrated herein includes the main inlet passage 40 extending from the main inlet port 36 to the main throat 44 and the main outlet passage 42 extending from the first throat 44 to the main outlet port 38. The endwall treatment 32 may include a second inlet passage 50 connecting a second inlet port 52 to the main recirculation passage 34 at or near to the main throat 44. A second throat 53 may be disposed in the second inlet passage 50 at or near an intersection 149 of the second inlet passage 50 and the main recirculation passage 134. The second inlet port 52 is an intermediate inlet port axially located along the shroud 22 between the main inlet port 36 and the main outlet port 38. The second inlet port 52 is generally axially located between the leading and trailing edges 12, 14 of the blade 10 at the blade tip 24.

Figure 2:
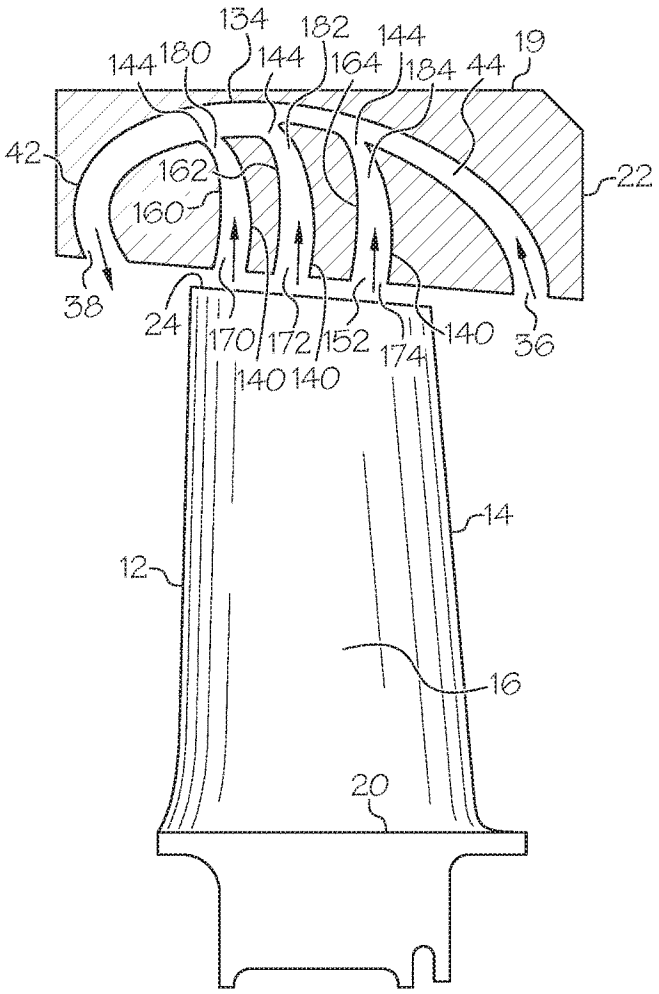
FIG. 2 is a cross-sectional view schematic illustration of a compressor blade circumscribed by a shroud having an alternative Venturi effect endwall treatment with multiple axially spaced apart inlet ports and passages.

FIG. 2 illustrates another alternative endwall treatment 32 having two or more clustered inlet passages 140 in place of the second inlet passage 50. The shroud 22 or endwall 19 includes two or more clustered inlet passages 140 (3 are illustrated) extending from two or more clustered secondary inlet ports 152 to two or more intersections 149 of the two or more clustered inlet passages 140 respectively and the main recirculation passage 134. The two or more clustered inlet passages 140 may extend from the two or more clustered secondary inlet ports 152 to or near two or more clustered secondary throats 144 at or near the two or more intersections 149 of the two or more clustered inlet passages 140 respectively and the main recirculation passage 134.

The embodiment of the endwall treatment 32 illustrated in FIG. 2 includes the main inlet port 36 located axially aft and downstream of the blade tip 24. The embodiment of the endwall treatment 32 illustrated in FIG. 2 further includes the main outlet port 38 to the main recirculation passage 34 and the main outlet passage 42 located axially forward and upstream of the blade tip 24. Second, third, and fourth clustered intermediate inlet passages 160, 162, 164 connect second, third, and fourth intermediate ports 170, 172, 174 to the main recirculation passage 34 at or near to second, third, and fourth intermediate throats 180, 182, 184 in the second, third, and fourth intermediate inlet passages 160, 162, 164 respectively. The second, third, and fourth intermediate ports 170, 172, 174 are generally axially located between the leading and trailing edges 12, 14 of the blade 10 at the blade tip 24.

Figure 3:
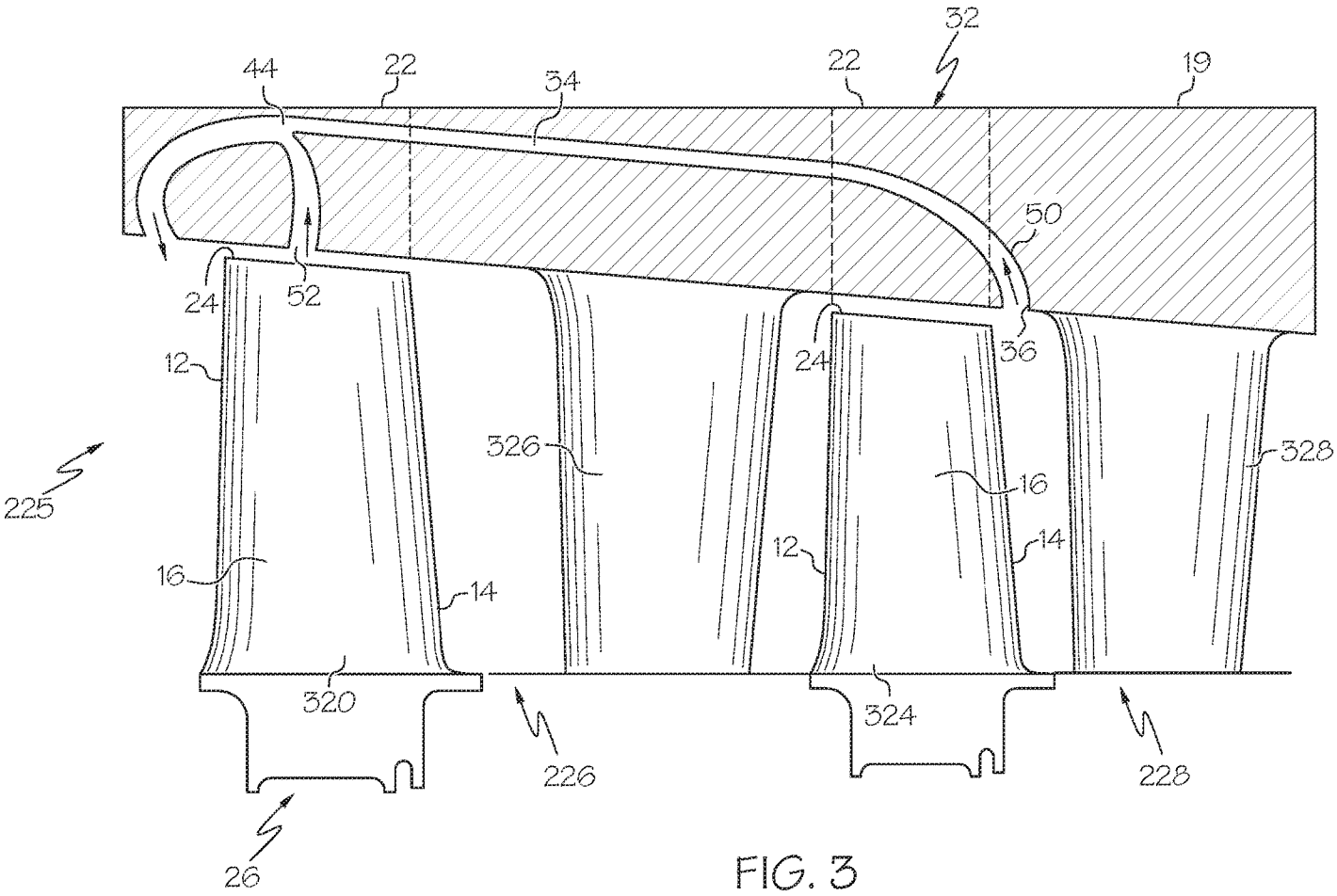
FIG. 3 is a cross-sectional view schematic illustration of a compressor blade circumscribed by a shroud having a second alternative Venturi effect endwall treatment with two multiple inlet ports in different compressor stages.

FIG. 3 illustrates another Venturi effect alternative endwall treatment 32, in the endwall 19 and the shroud 22, having one or more inlet ports 36 in one or more compressor stages downstage of the compressor stage containing the second inlet port 52. A gas turbine engine compressor assembly 225 includes at least two stages 26 denoted herein as upstream and downstream stages 226, 228. Two or more inlet ports 36 are located in the two different stages 26. The upstream and downstream stages 226 and 228 include upstream and downstream stage blades 320, 324 which may be followed downstream by upstream and downstream stage stators or vanes 326, 328 respectively as illustrated herein.

As compared to the embodiment illustrated in FIG. 1, the main inlet port 36 is located in the downstream stage 228 that is located one or more stages axially aft and downstream of the upstream stage blades 320 and of the second inlet port 52. The main inlet port 36 is connected to the main recirculation passage 34 at or near to the first throat 44 by the second inlet passage 50. The main inlet port 36 is generally axially located between the leading and trailing edges 12, 14 of the downstream stage blades 324 at the blade tips 24. Note, that the downstream stage 228 is the next stage down or one stage downstream from the upstream stage 226 in the embodiment illustrated in FIG. 3. The downstream stage 228 may also be two or more stages down or downstream from the upstream stage 226. The second inlet port 52 may and, if used, the clustered secondary inlet ports 152, illustrated in FIG. 2, may be in the first or upstream stage 226 radially spaced apart and in the vicinity of the blade tips 24 of the upstream stage blades 320.

Figure 5:
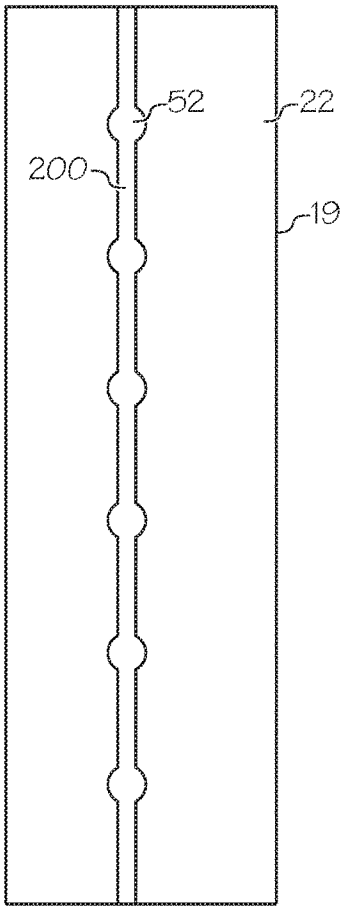
FIG. 5 is a planform view schematic illustration of the annular slot passing through the inlet ports illustrated in FIG. 4.
Figure 4:
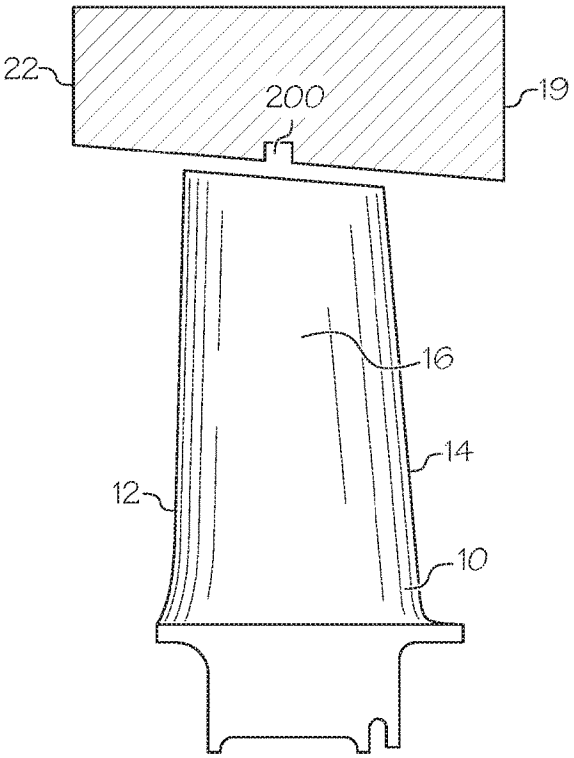
FIG. 4 is a cross-sectional view schematic illustration of an annular slot in the shroud passing through the inlet ports illustrated in FIG. 1.
Figure 7:
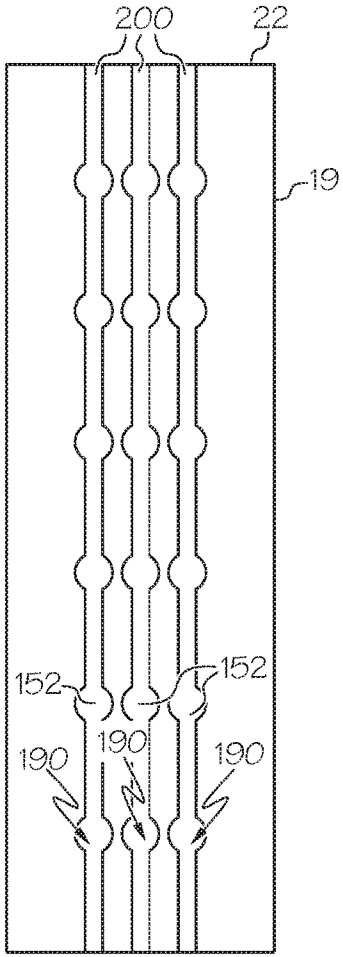
FIG. 7 is a planform view schematic illustration of the annular slot passing through the inlet ports illustrated in FIG. 6.
Figure 6:
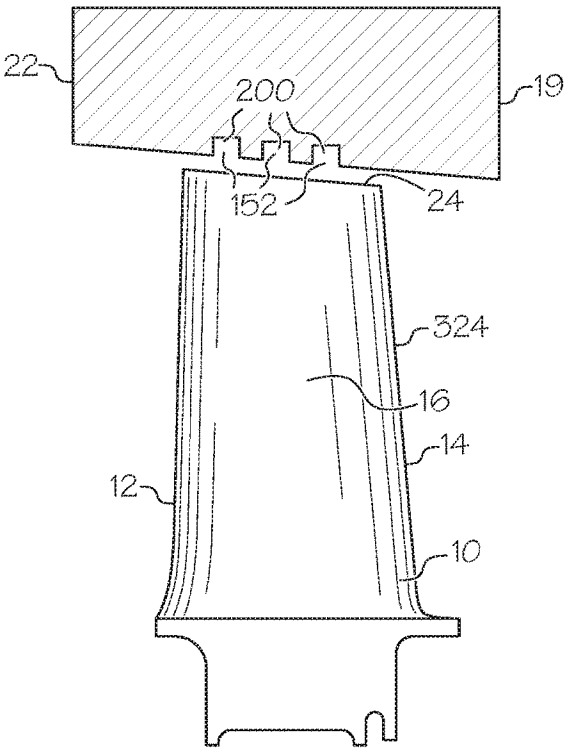
FIG. 6 is a cross-sectional view schematic illustration of a group of annular slots in the shroud passing through the inlet ports illustrated in FIG. 3.

FIGS. 4 and 5 illustrate an annular groove 200 in the endwall 19 or the shroud 22. The annular groove 200 passes through and interconnects the second inlet ports 52 around the endwall 19 or the shroud 22. The main inlet port 36 is generally axially located aft of the blade 10 illustrated in FIG. 1 or aft of the and trailing edge 14 of the downstream stage blade 324 illustrated in FIG. 3, at the blade tip 24. FIGS. 6 and 7 illustrate annular grooves 200 in the endwall 19 or the shroud 22. The annular grooves 200 pass through and interconnect the two or more clustered secondary inlet ports 152 in circular rows 190 around the endwall 19 or the shroud 22 illustrated in FIG. 2. The two or more clustered secondary inlet ports 152 are generally axially located between the leading and trailing edges 12, 14 of the upstream stage blades 320 at the blade tip 24.

The present invention has been described in connection with specific examples, embodiments, materials, etc. However, it should be understood that they are intended to be representative of, rather than in any way limiting on, its scope. Those skilled in the various arts involved will understand that the invention is capable of variations and modifications without departing from the scope of the appended claims.

What is claimed is:

1. A gas turbine engine endwall treatment comprising:

a plurality of main recirculation passages distributed circumferentially around and extending generally axially in an endwall or shroud, each of the main recirculation passages including a Venturi effect producing main throat disposed between a main inlet passage and a main outlet passage, main inlet and outlet ports of the main inlet and outlet passages respectively extending through the endwall or shroud, and the main inlet port located axially aft and downstream of the main outlet port in each of the main recirculation passages;

further comprising second inlet passages connecting second inlet ports in the endwall or the shroud to the main recirculation passages at or near to the main throats and the second inlet ports distributed in a circular row around the endwall or the shroud.

2. The endwall treatment as claimed in claim 1 further comprising second throats disposed in the second inlet passages at or near intersections of the second inlet passages and the main recirculation passages.

3. The endwall treatment as claimed in claim 1 further comprising an annular groove in the shroud or endwall and passing through and interconnecting the second inlet ports distributed circumferentially around the endwall or the shroud.

4. A gas turbine engine endwall treatment comprising:

a plurality of main recirculation passages distributed circumferentially around and extending generally axially in an endwall or shroud, each of the main recirculation passages including a Venturi effect producing main throat disposed between a main inlet passage and a main outlet passage, main inlet and outlet ports of the main inlet and outlet passages respectively extending through the endwall or shroud, and the main inlet port located axially aft and downstream of the main outlet port in each of the main recirculation passages;

further comprising two or more clustered inlet passages extending from two or more clustered secondary inlet ports to two or more intersections of the two or more clustered inlet passages respectively and the main recirculation passage in the shroud or endwall.

5. The endwall treatment as claimed in claim 4, further comprising the two or more clustered inlet passages extending from the two or more clustered secondary inlet ports to two or more clustered secondary throats at or near the two or more intersections of the two or more clustered inlet passages respectively and the main recirculation passage in the shroud or endwall.

6. The endwall treatment as claimed in claim 4, further comprising two or more annular grooves in the shroud or endwall and the two or more annular grooves passing through and interconnecting the second inlet ports distributed circumferentially around the endwall or the shroud in circular rows of the second inlet ports respectively.

7. A gas turbine engine compressor stage comprising:

a circular row of compressor blades including axially spaced apart leading and trailing edges and airfoils extending radially outwardly to blade tips, an endwall including a shroud circumscribing the blade tips and the tips generally radially located in close proximity to the endwall and the shroud, an endwall treatment located in the endwall and including a plurality of main recirculation passages or passages distributed circumferentially around and extending generally axially in an endwall or shroud, Venturi effect producing main throats disposed between main inlet and outlet passages including main inlet and outlet ports respectively extending through the endwall or shroud, the main inlet ports located axially aft and downstream of the blade tips and the main outlet ports located axially forward and upstream of the blade tips, and the main inlet ports located axially aft and downstream of the main outlet ports in the main recirculation passages;

further comprising second inlet passages connecting a circular row of second inlet ports in the endwall or the shroud to the main recirculation passages at or near to the main throats.

8. The gas turbine engine compressor stage as claimed in claim 7, further comprising second throats disposed in the second inlet passages at or near intersections of the second inlet passages and the main recirculation passages.

9. The gas turbine engine compressor stage as claimed in claim 7, further comprising an annular groove in the shroud or endwall and passing through and interconnecting the second inlet ports distributed circumferentially around the endwall or the shroud.

10. A gas turbine engine compressor stage comprising:

a circular row of compressor blades including axially spaced apart leading and trailing edges and airfoils extending radially outwardly to blade tips, an endwall including a shroud circumscribing the blade tips and the tips generally radially located in close proximity to the endwall and the shroud, an endwall treatment located in the endwall and including a plurality of main recirculation passages or passages distributed circumferentially around and extending generally axially in an endwall or shroud, Venturi effect producing main throats disposed between main inlet and outlet passages including main inlet and outlet ports respectively extending through the endwall or shroud, the main inlet ports located axially aft and downstream of the blade tips and the main outlet ports located axially forward and upstream of the blade tips, and the main inlet ports located axially aft and downstream of the main outlet ports in the main recirculation passages;

further comprising two or more clustered inlet passages extending from two or more clustered secondary inlet ports to two or more intersections of the two or more clustered inlet passages respectively and the main recirculation passage in the shroud or endwall.

11. The gas turbine engine compressor stage as claimed in claim 10, further comprising the two or more clustered inlet passages extending from the two or more clustered secondary inlet ports to two or more clustered secondary throats at or near the two or more intersections of the two or more clustered inlet passages respectively and the main recirculation passage in the shroud or endwall.

12. The gas turbine engine compressor stage as claimed in claim 10, further comprising two or more annular grooves in the shroud or endwall and the two or more annular grooves passing through and interconnecting the second inlet ports distributed circumferentially around the endwall or the shroud in circular rows of the second inlet ports respectively.

13. A gas turbine engine compressor assembly comprising:

upstream and downstream stages including upstream and downstream stage blades, the upstream and downstream stage blades including axially spaced apart leading and trailing edges and airfoils extending radially outwardly to blade tips, an endwall including shrouds circumscribing the blade tips and the tips generally radially located in close proximity to the endwall and the shrouds, an endwall treatment located in the endwall and including a plurality of main recirculation passages distributed circumferentially around and extending generally axially in an endwall or shroud, Venturi effect producing main throats disposed between main inlet and outlet passages including main inlet and outlet ports respectively extending through the endwall or shroud, the main inlet ports located axially aft and downstream of the blade tips of the downstream stage blades and the main outlet ports located axially forward and upstream of the blade tips of the upstream stage blades, and the main inlet ports located axially aft and downstream of the main outlet ports in the main recirculation passages.

14. The gas turbine engine compressor assembly as claimed in claim 13, further comprising second inlet passages connecting a circular row of second inlet ports in the endwall or the shroud to the main recirculation passages at or near to the main throats.

15. The gas turbine engine compressor assembly as claimed in claim 14, further comprising second throats disposed in the second inlet passages at or near intersections of the second inlet passages and the main recirculation passages.

16. The gas turbine engine compressor assembly as claimed in claim 14, further comprising an annular groove in the shroud or endwall and passing through and interconnecting the second inlet ports distributed circumferentially around the endwall or the shroud.

17. The gas turbine engine compressor assembly as claimed in claim 14, further comprising the downstream stage being two or more stages downstream from the upstream stage.

* * * * *